US007102489B2

(12) United States Patent
Motosugi et al.

(10) Patent No.: US 7,102,489 B2
(45) Date of Patent: Sep. 5, 2006

(54) IMAGE FORMING APPARATUS AND CONTROL METHOD THEREOF

(75) Inventors: Toshihisa Motosugi, Okazaki (JP); Kenichi Matsumoto, Toyokawa (JP); Taketoshi Yamahata, Toyokawa (JP); Tsuyoshi Yoneyama, Hachioji (JP); Jiro Goto, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 150 days.

(21) Appl. No.: 10/782,921

(22) Filed: Feb. 23, 2004

(65) Prior Publication Data

US 2005/0073393 A1 Apr. 7, 2005

(30) Foreign Application Priority Data

Sep. 18, 2003 (JP) ..... 2003-325803

(51) Int. Cl.
*G08B 1/00* (2006.01)

(52) U.S. Cl. ..... 340/309.7; 340/815.61; 340/309.5; 399/24; 399/258; 219/216

(58) Field of Classification Search ..... 340/309.7, 340/815.61, 309.3, 309.4, 309.5; 219/216; 399/24, 26, 9, 130, 258, 31, 38, 67; 430/111.4
See application file for complete search history.

(56) References Cited

U.S. PATENT DOCUMENTS 4,551,000 A * 11/1985 Kanemitsu et al. ..... 399/111
4,771,313 A * 9/1988 Kuroda et al. ..... 399/25
4,851,875 A * 7/1989 Tanimoto ..... 399/24
5,500,716 A * 3/1996 Morishita et al. ..... 399/35
RE35,751 E * 3/1998 Midgley ..... 399/25
6,783,231 B1 * 8/2004 Kim ..... 347/108

FOREIGN PATENT DOCUMENTS

| | | | |
|---|---|---|---|
| JP | 02-136868 A | | 5/1990 |
| JP | 06-138768 | | 5/1994 |
| JP | 06-156803 A | | 6/1994 |
| JP | 2000341461 | * | 8/2000 |
| JP | 2000-341461 | | 12/2000 |
| JP | 2001-109357 A | | 4/2001 |
| JP | 2002-055568 A | | 2/2002 |

* cited by examiner

*Primary Examiner*—Daniel Wu
*Assistant Examiner*—Daniel Previl
(74) *Attorney, Agent, or Firm*—Morrison & Foerster LLP

(57) ABSTRACT

An image forming apparatus has a first detector for detecting that a consumption article has reached its life, a second detector for detecting that the consumption article has reached a certain timing before its life, a third detector for detecting an application of power and/or releasing of a power saving mode of the image forming apparatus, a first controller for making a display portion display an alarm advising a replacement of the consumption article and for making the image forming apparatus inactivate, and a second controller for releasing the alarm display and enabling the use of the image forming apparatus when a specific input is operated during the displaying of the alarm on the display portion.

14 Claims, 7 Drawing Sheets

IMAGE FORMING APPARATUS AND CONTROL METHOD THEREOF

Priority is claimed to Japanese Patent Application No. 2003-325803, filed on Sep. 18, 2003, the disclosure of which is incorporated by reference in its entirety.

BACKGROUND OF THE INVENTION

1. Field of the Invention

The present invention relates to an image forming apparatus, such as a copying machine, a printer, a facsimile machine, or a MFP (Multi Function Peripheral) which is a combined machine having multiple functions including a copying function, a printing function, a scanner function and a facsimile function, for example.

2. Description of Related Art

The following description sets forth the inventor's knowledge of related art and problems therein and should not be construed as an admission of knowledge in the prior art.

For example, the aforementioned MFP is equipped with various consumption articles such as a photosensitive element, a fixing roller and a toner cartridge in an exchangeable manner.

These consumption articles once come to the end of their lives, they become a non-usable state (hereinafter may be referred to as "life"). Therefore, for the purpose of advising the user to replace the consumption article with new one, a conventional apparatus detects the status in which the consumption article came to near the end of the life but is still in a usable state (hereinafter may be referred to as "near life") and displays the status on the display portion thereof to give an alarm for the replacement against the user.

For example, Japanese Unexamined Patent Laid-open Publication H6-138768 A discloses a technique for assuredly detecting whether a toner as a consumption article has come to the empty state to give an advance notice of the toner empty without fail.

Irrespective of such conventional technique, despite the advance notice of the replacement of the consumption article that has reached its near life, the apparatus can be used continuously until the consumption article has finally reached the life without requesting the user to perform a specific operation. Therefore, it was difficult to make the user recognize the necessity of the early replacement of the consumption article.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

It is an object of the present invention to provide an image forming apparatus capable of making users recognize an early replacement of consumption articles that have reached its near life.

It is another object of the present invention to provide a control method of an image forming apparatus capable of making users recognize an early replacement of consumption articles that have reached its near life.

According to the first aspect of the present invention, an image forming apparatus includes a first detector for detecting that a consumption article has reached its life, a second detector for detecting that the consumption article has reached a certain timing before its life, a third detector for detecting an application of power and/or releasing of a power saving mode of the image forming apparatus, a first controller for making a display portion provided at the image forming apparatus display an alarm advising a replacement of the consumption article and for making the image forming apparatus inactivate in a case where the application of power and/or the releasing of the power saving mode of the image forming apparatus is detected by the third detector after the second detector detects that the consumption article has reached the certain timing before its life but before the first detector detects that the consumption article has reached its life; and a second controller for releasing the alarm display and enabling the use of the image forming apparatus when a specific input means is operated during the displaying of the alarm on the display portion.

According to the second aspect of the present invention, a control method of an image forming apparatus equipped with a first detector for detecting that a consumption article has reached its life, a second detector for detecting that the consumption article has reached a certain timing before its life, and a third detector for detecting an application of power and/or releasing of a power saving mode of the image forming apparatus, the method including the steps of: a step of executing a content of a first controller for making a display portion provided at the image forming apparatus display an alarm advising a replacement of the consumption article and for making the image forming apparatus inactivate in a case where the application of power and/or the releasing of the power saving mode of the image forming apparatus is detected by the third detector after the second detector detects that the consumption article has reached the certain timing before its life but before the first detector detects that the consumption article has reached its life; and a step of executing a content of a second controller for releasing the alarm display and enabling the use of the image forming apparatus when a specific input means is operated during the displaying of the alarm on the display portion.

Other objects and the features will be apparent from the following detailed description of the present invention with reference to the attached drawings.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspects or features of other embodiments where applicable. The descriptions of aspects, features and/or advantages of particular embodiments should not be construed as limiting other embodiments or the claims.

BRIEF DESCRIPTION OF THE DRAWINGS

The accompanying figures are provided by way of example, without limiting the broad scope of the invention or various other embodiments, wherein.

DETAILED DESCRIPTION OF THE PREFERRED EMBODIMENTS

An image forming apparatus according to the present invention will be explained based on an embodiment applied to a digital full-color MFP. In the following explanation, a digital full-color MFP will be simply referred to as "MFP."

Figure 1:
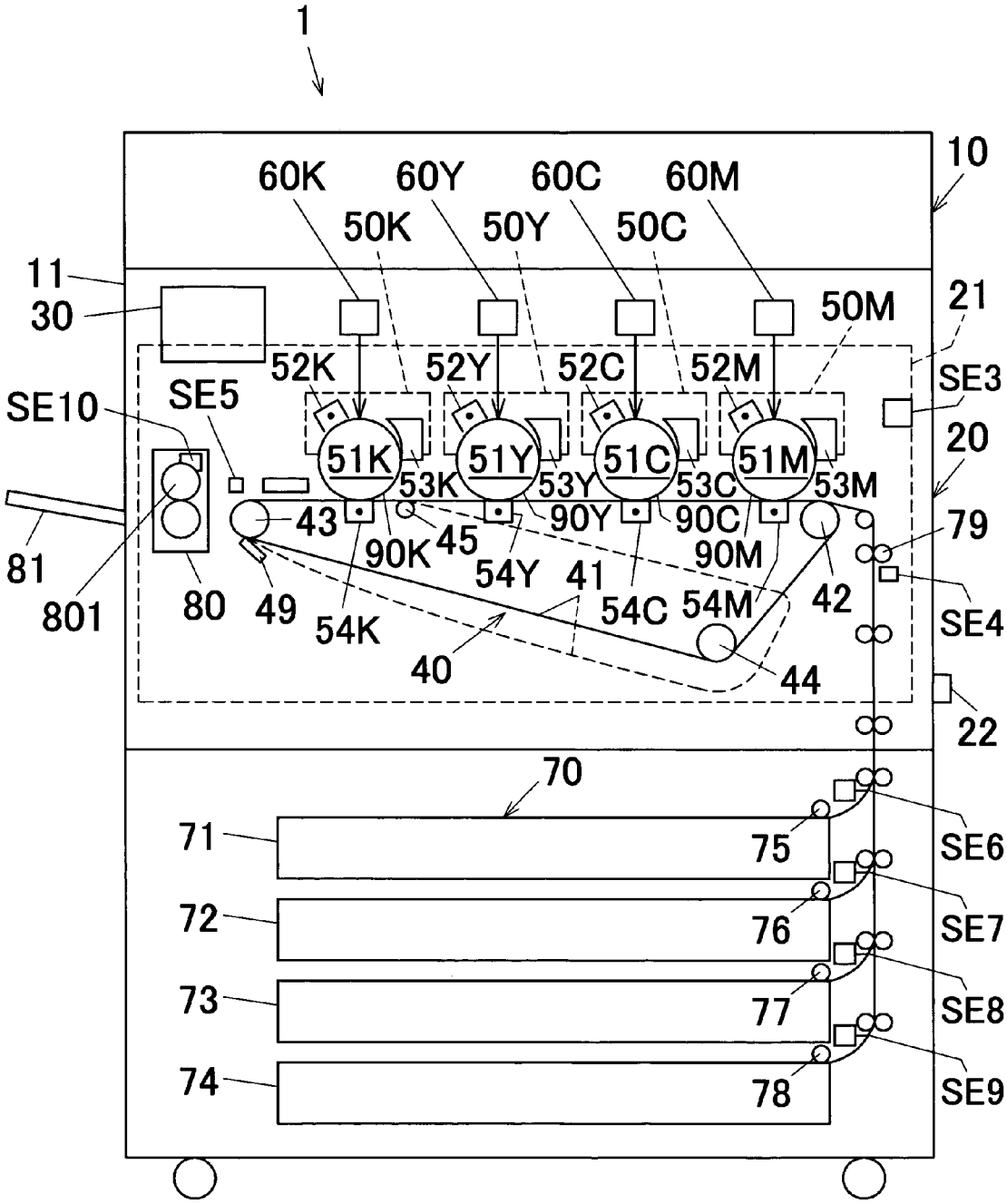
FIG. 1 is a schematic structural view showing a digital full-color MFP according to an embodiment of the present invention.

FIG. 1 shows the entire structure of the MFP1. As shown in FIG. 1, this MFP1 is provided with an image reading portion 10 for reading an original image and a printing portion 20 for reproducing the read image on a recording sheet.

The image reading portion 10 is a publicly known image reader in which an image of an original disposed on an original disposing glass plate (not shown) is read while moving a scanner. The original image obtained by being irradiated by an exposure lamp equipped to the scanner is focused by a condenser and then divided into three lights different in wave lengths, i.e., red (R), green (G) and blue (B), which will be entered into a CCD image sensor for red color, a CCD image sensor for green color and a CCD image sensor for blue color, respectively. The output signal from each CCD image sensor is converted into AD signals to thereby obtain R, G, B image data of the original.

The image data of each color component obtained by the image reading portion 10 is subjected to various data processing in a control portion 30 to be converted into image data of each reproduced color of cyan (C), magenta (M), yellow (Y) and black (B) (hereinafter, each reproduced color of cyan, magenta, yellow and black will be referred to as "C," "M," "Y" and "K" which will be added to reference numerals associated with each corresponding reproduced color as index).

The image data is stored in the image memory in the control portion 30 per each reproduced color and subjected to required image corrections for displacement corrections. Thereafter, the image data is read out per each scanning line in synchronized with the feeding of recording sheets to become a driving signal of a laser diode.

The printing portion 20 forms an image by a well-known electrophotographic method. This printing portion 20 includes a recording sheet transferring portion 40 with a transferring belt 41, image processing portions 50M, 50C, 50Y and 50K for each color M, C, Y and K disposed so as to face to the transferring belt 41 at certain intervals from the upstream side of the recording sheet transferring direction (hereinafter simply referred to as "upstream") toward the downstream side of the recording sheet transferring direction (hereinafter simply referred to as "downstream"), exposure scanning portions 60M, 60C, 60Y and 60K provided at each image processing portions 50M, 50C, SOY and 50K, a paper feeding portion 70 for feeding recording sheets to the upstream side of the recording sheet transferring portion 40, and a fixing portion 80 disposed at the downstream side.

Each of the exposure scanning portions 60M, 60C, 60Y and 60K is provided with a laser diode for emitting a laser beam in accordance with a driving signal outputted from the control portion 30 and a polygonal mirror for scanning in the main scanning direction above photosensitive drums 51M, 51C, 51Y and 52K while polarizing the laser beam, for example.

Each of the image processing portions 50M (50C, SOY, 50K) includes a photosensitive drum 51M (51C, SOY, 50K), an electrostatic charger 52M (52C, 52Y, 52K) disposed around the drum, a developer 53M (53C, 53Y, 53K) and a transferring charger 54M (54C, 54Y, 50K), which are stored in a single casing as a unit for easy maintenance.

The paper feeding portion 70 includes paper feed cassettes 71 to 74 for storing recording sheets different in size, pickup rollers 75 to 78 for feeding the recording sheets from the paper feed cassette, resist rollers 79 for adjusting the timing of feeding the recording sheet to the transferring belt 41, etc.

In the photosensitive drum 51M (51C, 51Y, 51K), remaining toner adhered on the surface of the drum is removed with a cleaner (not shown) before the exposure of the drum, and then the drum is irradiated by an eraser lamp (not shown) to remove the static charge. Thereafter, the drum is uniformly charged with the electrostatic charger 52M (52C, 52Y, 52K). In this uniformly charged state, when the laser beam is exposed to the photosensitive drum 51M (51C, 51Y, 51K), electrostatic latent image will be formed on the surface of the drum.

Each electrostatic latent image is developed by the developers 53M, 53C, 53Y and 53K of respective colors, whereby toner images of M, C, Y and K are formed on the respective surfaces of the photosensitive drums 51M, 51C, 51Y and 51K. These toner images are transferred on the recording sheet fed by the recording sheet transferring portion 40 by the electrostatic function of the respective transferring chargers 54M, 54C, 54Y and 54K disposed at the respective transferring positions from the rear side of the transferring belt 41.

At this time, the image forming operation of each color is executed by delaying the timing of the image forming operation from the upstream side toward the downstream side so that the toner image of each color can be transferred on the same position of the recording sheet in an overlapped state. The recording sheet on which toner images of respective colors are transferred is conveyed to the fixing portion 80 by the transferring belt 41. Each fixing roller 801 of the fixing portion 80 is provided with an internal heater (not shown). The control portion 30 controls the power to the internal heater while detecting the surface temperature of the fixing roller 801 using the temperature detecting sensor SE10 to maintain the surface temperature at a prescribed fixing temperature. At this position, the recording sheet is pressed at high temperature and discharged onto the discharge tray 81 after the photographic fixing of the toner particles on the surface of the recording sheet. The aforementioned fixing portion 80 is an exchangeable unit. Hereinafter, the fixing portion 80 will be referred to as a fixing unit 80.

At the front side of the printing portion 20 of the apparatus housing 11, an openable and closable front door 21 is provided. Thus, by opening this front door 21, the maintenance of the apparatus, e.g., removing a jammed paper when a paper jam occurred in the paper transferring system, replacing a consumption article such as the fixing unit 80 or refilling toner, can be performed. The opening operation of this front door 21 is detected by a door open detecting sensor SE3 constituted by a limit switch or a slide switch, and the detected signal is transmitted to the control portion 30.

Another sensors SE4 to SE9 are jam sensors constituted by a reflection type photoelectric sensor or a limit switch. In the jam sensors SE3 to SE9, the control portion 30 discriminates that a paper jam occurred if a rear end of the recording sheet is not detected for a certain time period after the detection of the front end of the recording sheet or a front end of a recording sheet is not detected by a downstream side jam sensor for a certain time period after the detection of the rear end of the recording sheet by an upstream side jam sensor.

At the central position of the right side of the apparatus housing 11, a main power switch 22 is equipped. As will be explained later, the power supply to MFP1 by throwing the power switch 22 is detected by the system control portion 100 (shown in FIG. 2). Furthermore, in this MFP1 of this embodiment, the power mode will be changed into a power saving mode if no operation is made for a certain time period. In the power saving mode, if any operation is made, the power saving mode will be released. This release of the power saving mode will also be detected by the system control portion 100.

The recording sheet transferring portion 40 includes the transferring belt 41, a driving roller 42 on which the transferring belt 41 is put, a driven roller 43, a tension roller 44, a guide roller 45, etc.

The driving roller 42 is rotatably held at the right end portion of a swing frame (not shown) that is held and able to swing up and down about the rotation axis of the driven roller 43. This driving roller 42 is driven to rotate by a step motor (not shown) equipped at the swing frame, and the revolution speed is controlled by the control portion 30 so that the transferring speed of the transferring surface of the transferring belt 41 becomes the same speed of the peripheral speed (system speed) of the photosensitive drum 51M, 51C, 51Y and 51K.

Approximately beneath the driven roller 43, a cleaning blade 49 for removing the toner of the resist mark transferred on the transferring belt 41 is provided.

At an easy-to-operate position of the front side of the image reading portion 10, an operation panel portion 107 (shown in FIG. 2) is provided. With this operation panel portion 107, a user can perform a copy start instruction, setting of the number of copies or keystrokes for specifying a print mode. This operation panel portion 107 is provided with an LCD display portion 106 constituted by a liquid crystal display panel and a hard key operation portion 108 to display the copy mode set by a user or various messages on the LCD display 106.

In this MFP1 according to this embodiment, at the time of executing a color print mode, it is set such that all of the photosensitive drums 51M, 51C, 51Y and 51K come into contact with the record sheet transferring surface of the transferring belt 41 (see the solid line of the reference numeral 41 shown in FIG. 1). On the other hand, at the time of executing a monochromatic print mode, it is set such that the photosensitive drums 51M, 51C and 51Y that are not used for the image forming are detached from the transferring surface of the transferring belt 41 (see the broken line of the reference numeral 41 shown in FIG. 1). Thus, even if the photosensitive drums 51M, 51C and 51Y are brought to a halt at the time of monochromatic print mode, no friction generates between the transferring belt 41 and the drums. Accordingly, wasteful wear of the photosensitive surface of each photosensitive drum or it's peripheral members can be prevented without having harmful effects on the image forming. Each photosensitive drum 51M, 51C, 51Y, 51K as a consumption article is constituted as an exchangeable unit as an imaging unit 90M, 90C, 90Y, 90K.

Figure 2:
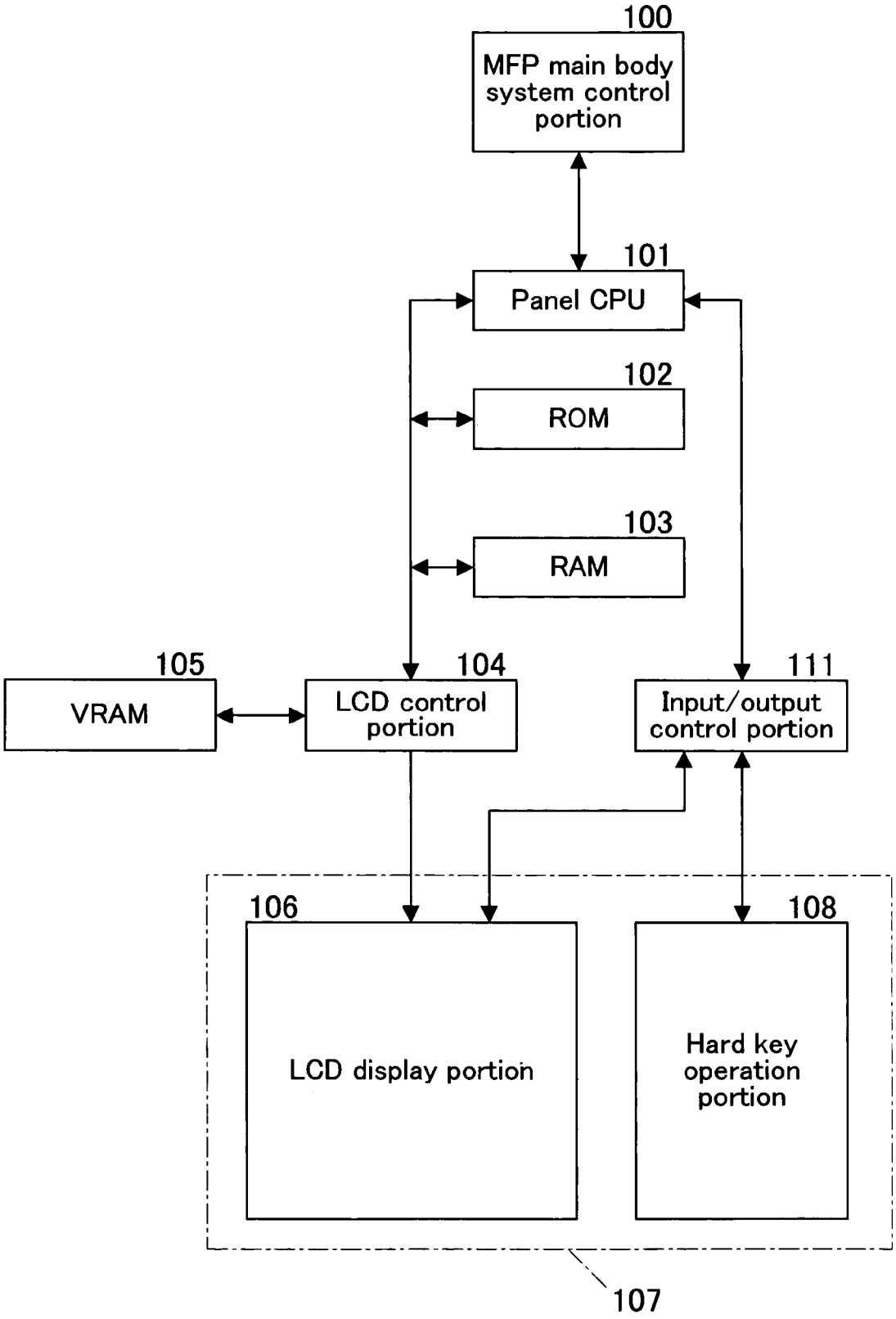
FIG. 2 is a block diagram of the circuit of the operation portion of the digital full-color MFP shown in FIG. 1.

FIG. 2 is a block diagram showing the circuit structure of the operation system of MFP1.

The reference numeral 101 denotes a panel CPU for controlling the entire operation panel portion 107. This panel CPU establishes the communication with the MFP main body system control portion 100 for controlling the entire MFP1.

The reference numeral 102 denotes a ROM for storing the operation portion controlling program and a plurality of display images, and the reference numeral 103 denotes a RAM which functions as a working memory for the panel CPU 101.

The reference numeral 104 denotes an LCD control portion that controls the reading/writing of the VRAM 105 and the image display on the LCD display portion 106. The image stored in the ROM 102 is stored in the VRAM 105 via the LCD control portion 104 by the panel CPU 101. Thereafter, the image is read out of the VRAM to be outputted to and displayed on the LCD display portion 106.

Furthermore, the LCD display portion 106 is formed into a touch panel. When the LCD display portion is touched, the touched position is discriminated by the input/output control portion 111, and then the selection of the function on the display is transmitted to the panel CPU 101 to execute the input control of the function setting or the like.

The hard key operation portion 108 is constituted by hard keys including a start key, ten keys and a panel reset key, an LED that shows the apparatus status and a buzzer that notifies input operations via the hard keys or the LCD display portion 106. This hard key operation portion 108 is controlled by the input/output control portion 111 and performs the communication with the system control portion 100 as needed. For example, pressing the start key in the hard key operation portion 108 establishes the communication with the system control portion 100 via the input/output control portion 111 and the panel CPU 101 to initiate a sequence of copying operations.

Regarding the consumption articles such as the fixing unit 80 or the imaging unit 90M to 90K of each color, the status of the consumption article, i.e., whether it has reached the near life or life, is decided based on the number of copying/printing operations (life counter). Concretely, each unit backs up the counted value and notifies the system control portion 100 of the status depending on the counted value. Then, the system control portion 100 discriminates whether it has reached its near life or life. In other words, the system control portion 100 functions as a detecting means for detecting the life or near life of consumption articles.

Figure 3:
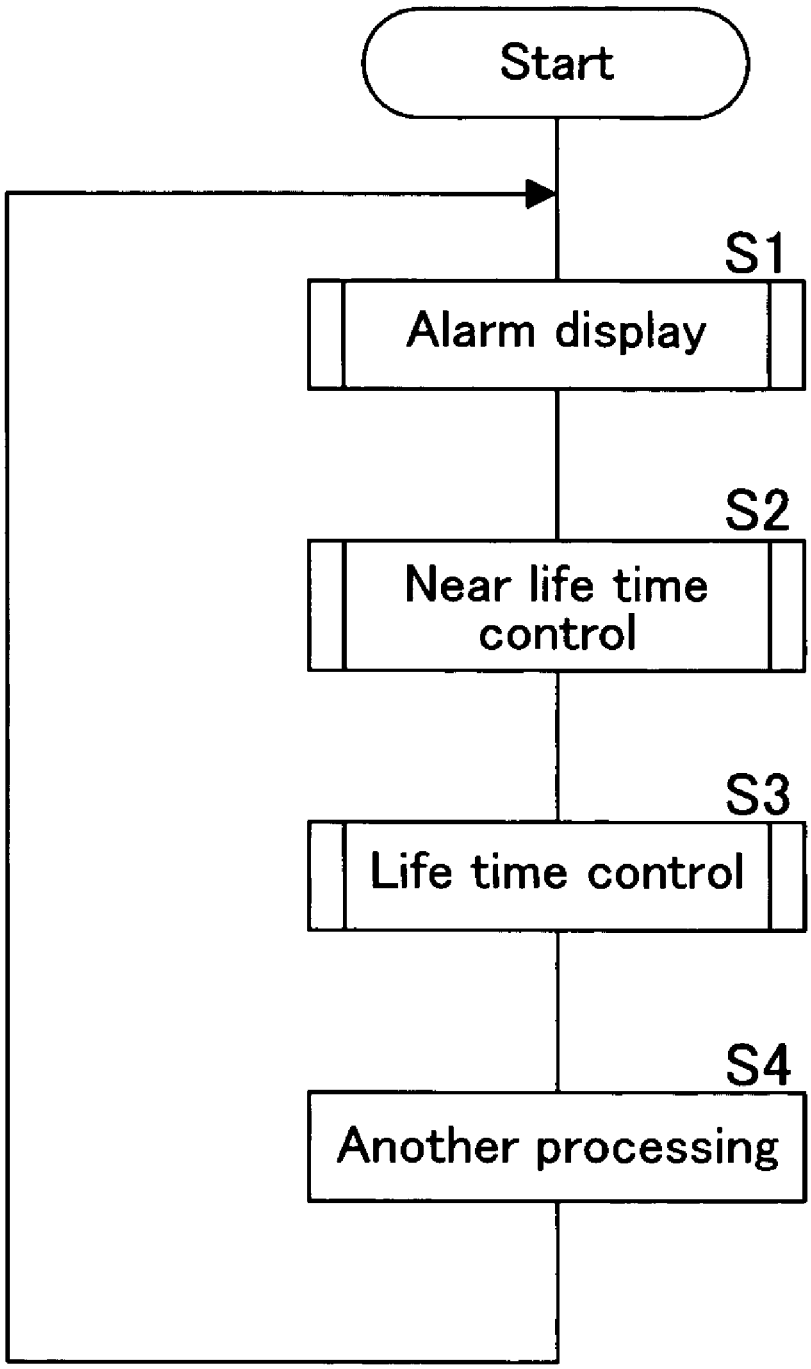
FIG. 3 is a main flowchart showing the operation of the digital full-color MFP shown in FIG. 1.

FIG. 3 shows the main flowchart regarding the processing of the display and the control to be executed by the system control portion 100 when the fixing unit 80 as an example of a consumption article has reached the life or near life. In the following explanation and drawings, Step will be abbreviated as "S."

Figure 4:
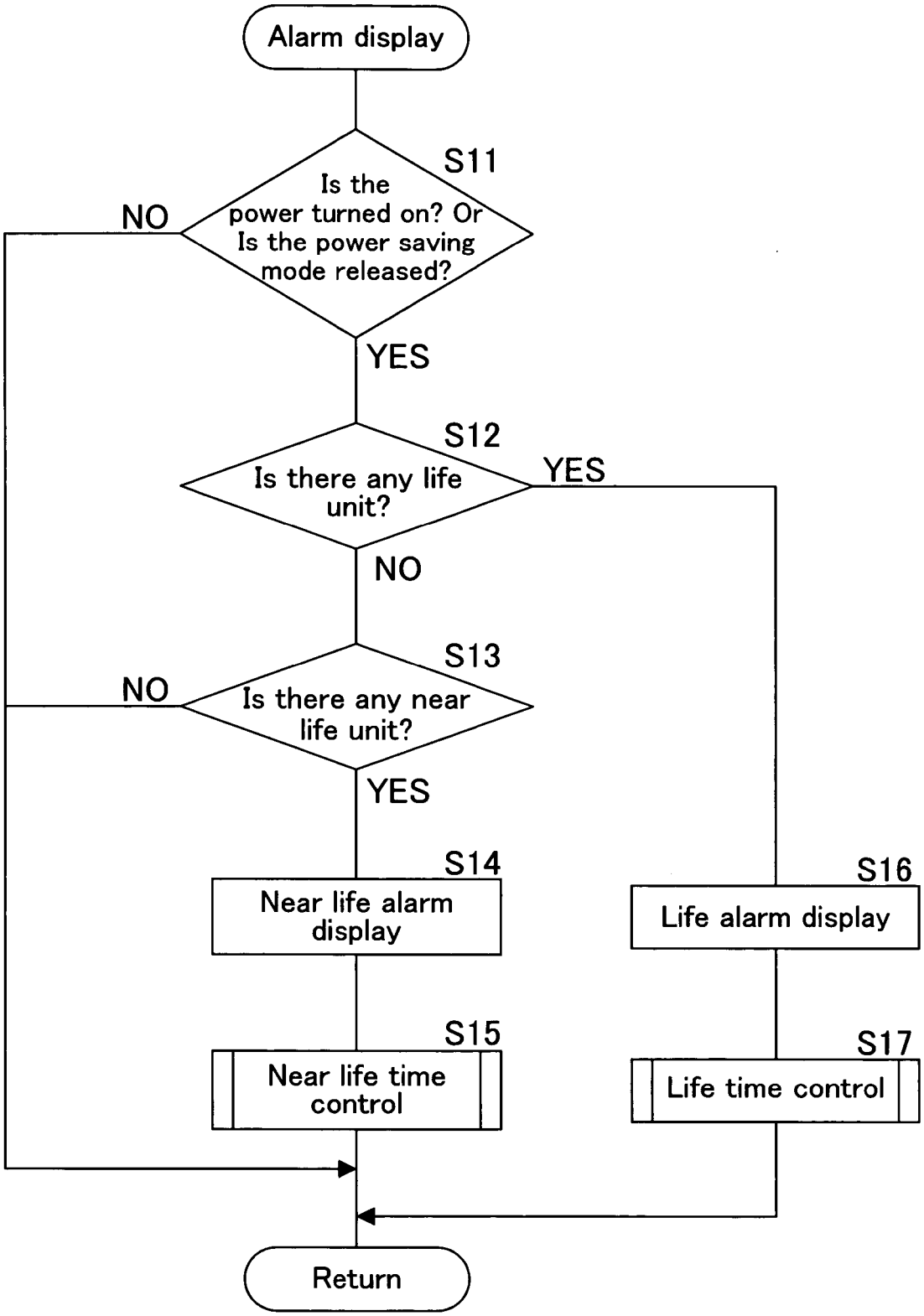
FIG. 4 is a flowchart showing the contents of the alarm display processing shown in FIG. 3.
Figure 5:
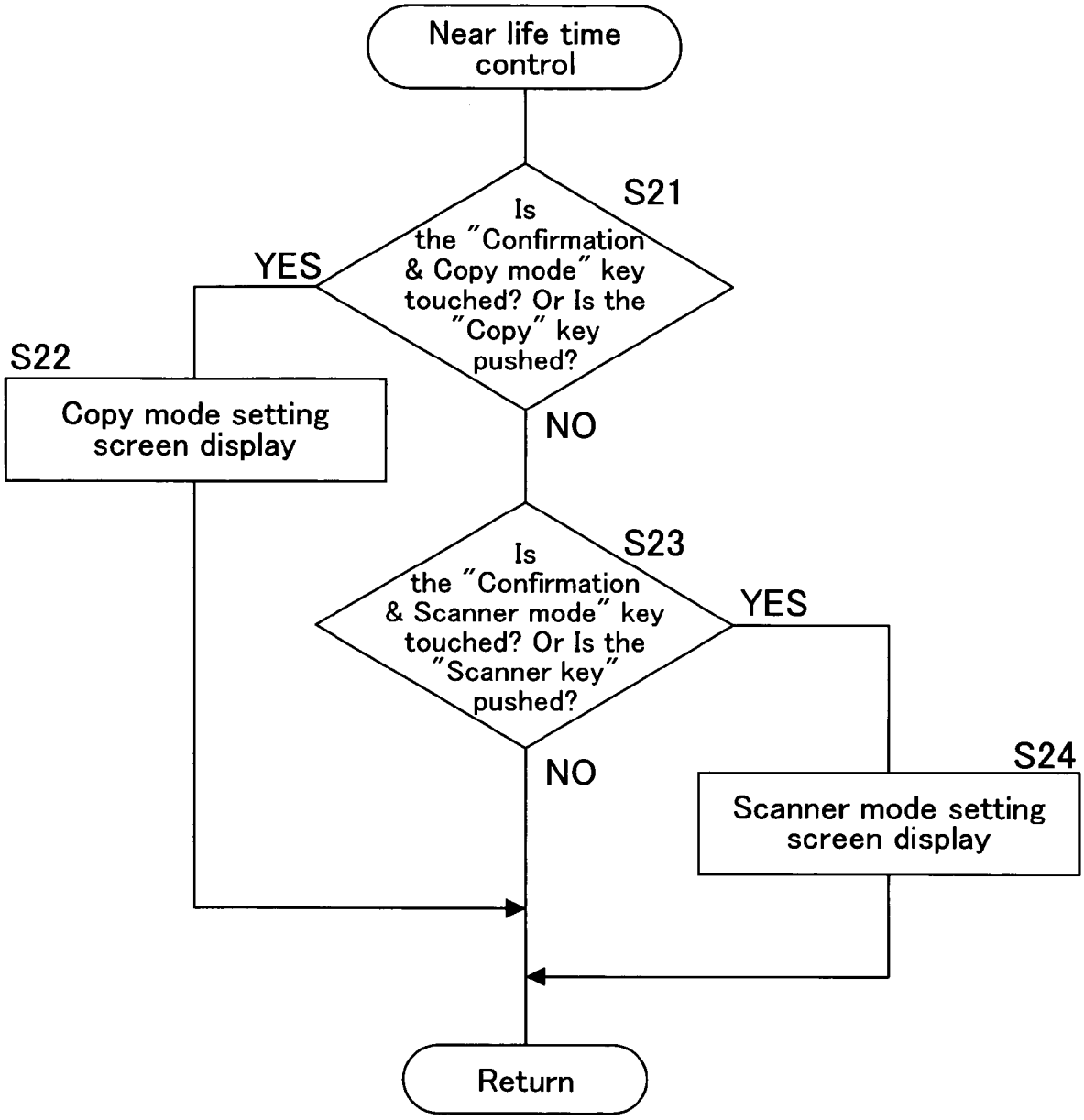
FIG. 5 is a flowchart showing the contents of the near life time control processing.
Figure 6:
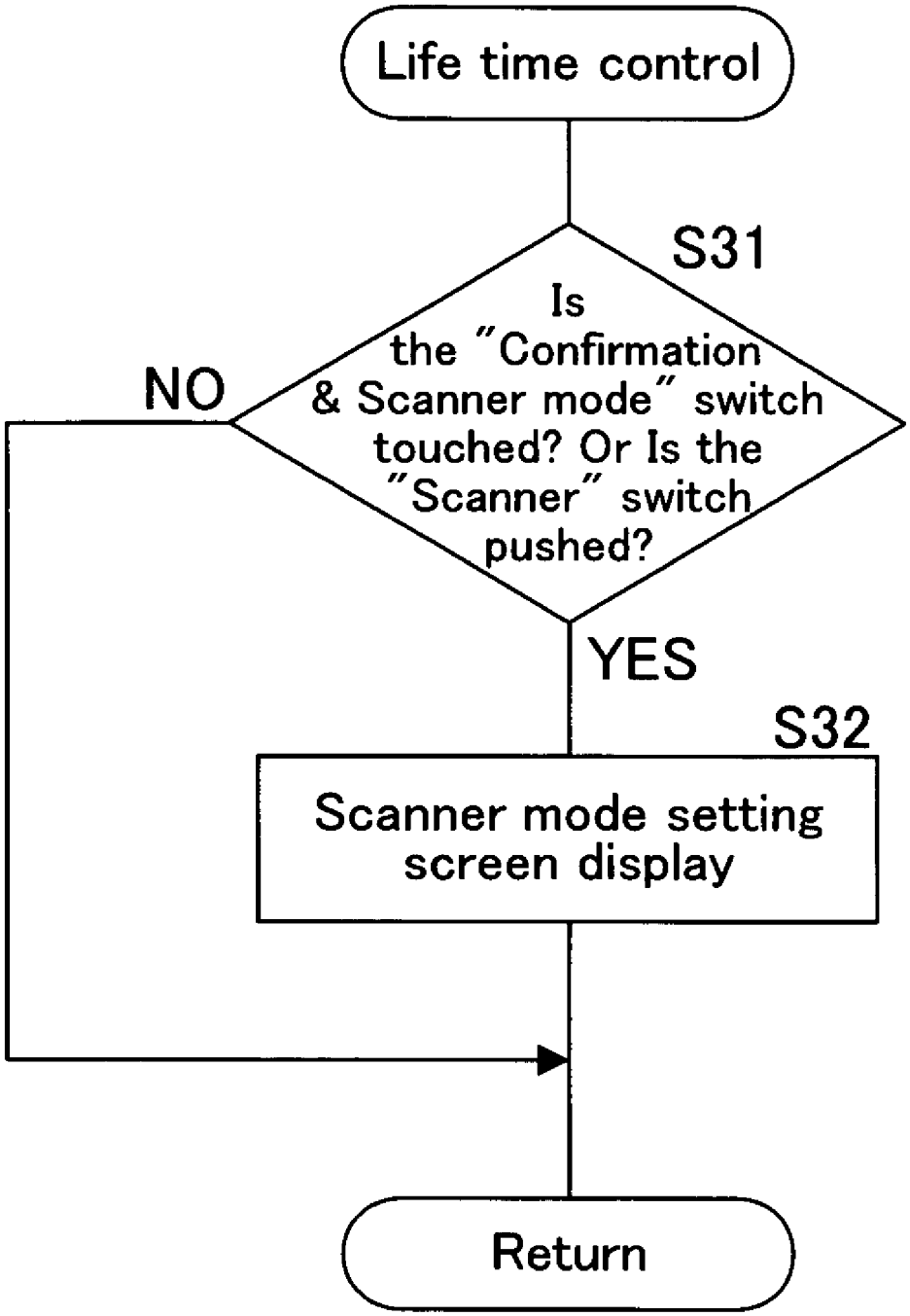
FIG. 6 is a flowchart showing the contents of the life time control processing shown in FIG. 3.

In FIG. 3, S denotes a step of the control processing related to the alarm display (the details are shown in FIG. 4), S2 denotes a step of the control processing in the near life status (the details are shown in FIG. 5), S3 denotes a step of the control processing in the life status (the details are shown in FIG. 6), and S4 denotes another processing (the details will be described later). The system control portion 100 repeatedly executes these steps S1 to S4.

First, the alarm display (S1) will be explained with reference to FIG. 4.

Figure 7A:
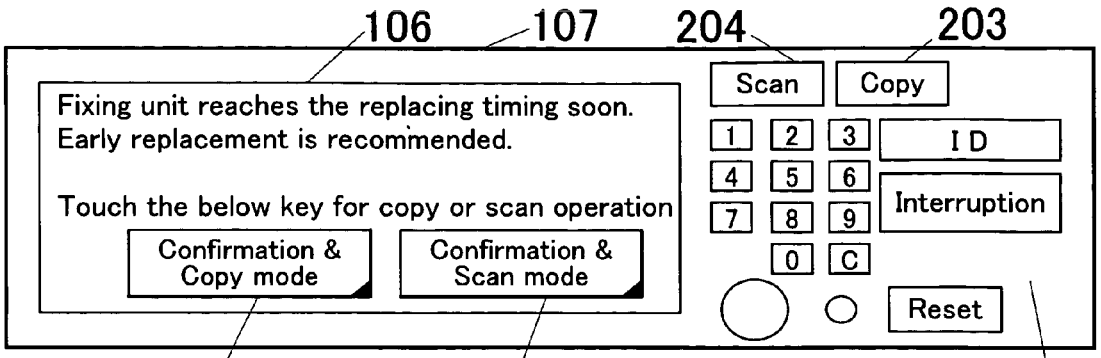
FIG. 7A shows an LCD display portion displaying a near life alarm display screen and a hard key operation portion.
Figure 7B:
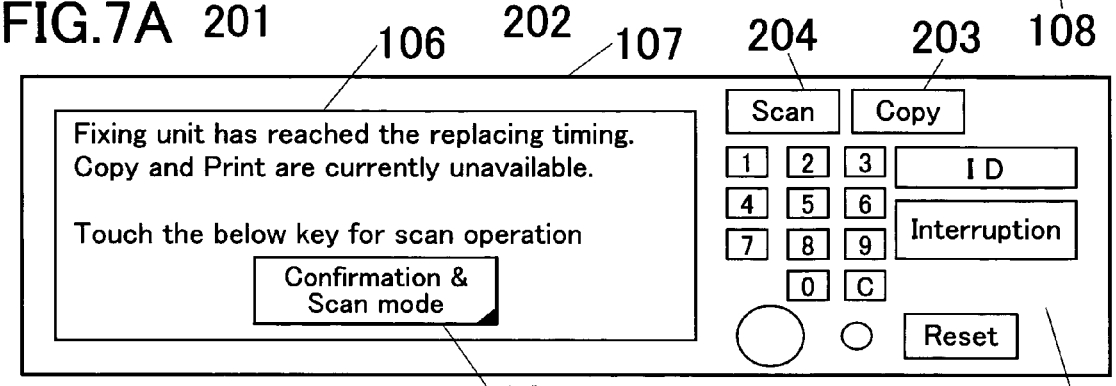
FIG. 7B shows an LCD display portion displaying a life alarm display screen and a hard key operation portion.

At S11, it is discriminated whether the power switch 22 is turned on or the power saving mode is released. If it is discriminated that the power switch 22 is not turned on or the power saving mode is not released (NO at S11), the routine returns. To the contrary, it is discriminated that the power switch 22 is turned on or the power saving mode is released (YES at S11), at S12, it is discriminated whether there is a consumption unit (in FIG. 4, simply referred to as "unit") which has reached the life. If there is a consumption unit which has reached the life (YES at S12), at S16, a life alarm is displayed as shown in FIG. 7B. In this alarm display, the entire display screen of the LCD display portion 106 indicates the facts that the fixing unit 80 has reached the life and copying and printing cannot be executed. Also indicated is a "Confirmation & Scanner mode" touch key 205 by which the user can confirm the aforementioned alarm and change the mode into a scanner mode.

In this display state, any function setting and operation cannot be executed unless a specific operation key such as the touch key 205 is touched/pushed. The detail explanation will be made later.

Subsequently, at S17, the life time control (the control to be performed when a consumption article has reached the life) is executed. The processing of this life time control is the same as in the processing of S3 shown in FIG. 3.

If it is discriminated that there is no consumption unit which has reached the life at S12 (NO at S12), at S13, it is discriminated whether there is any unit which has reached the near life. If it is discriminated that there is no unit which has reached the near life (No at S13), the routine returns. To the contrary, if it is discriminated that there is a unit which has reached the near life (YES at S13), at S14, a near life alarm display shown in FIG. 7A is displayed. In this alarm display, the entire display screen of the LCD display portion 106 indicates that the fixing unit 80 has reached the time near the replacement timing thereof and an early replacement is recommended. Also indicated are a "Confirmation & Copy mode" touch key 201 by which the user can confirm the aforementioned alarm and change the mode into a copy mode and a "Confirmation & Scanner mode" touch key 202" by which the user can confirm the aforementioned alarm and change the mode into a scanner mode.

In this display state too, any function setting and operation cannot be executed unless a specific operation key such as the touch key 201 or 202 is touched/pushed. The detail explanation will be made later.

Subsequently, at S15, the near life time control (the control to be performed when a consumption article has reached the near life) is executed. The processing of this near life time control is the same as in the processing of S2 shown in FIG. 3.

Next, the near life time control of S2 will be explained with reference to FIG. 5.

Figure 7C:
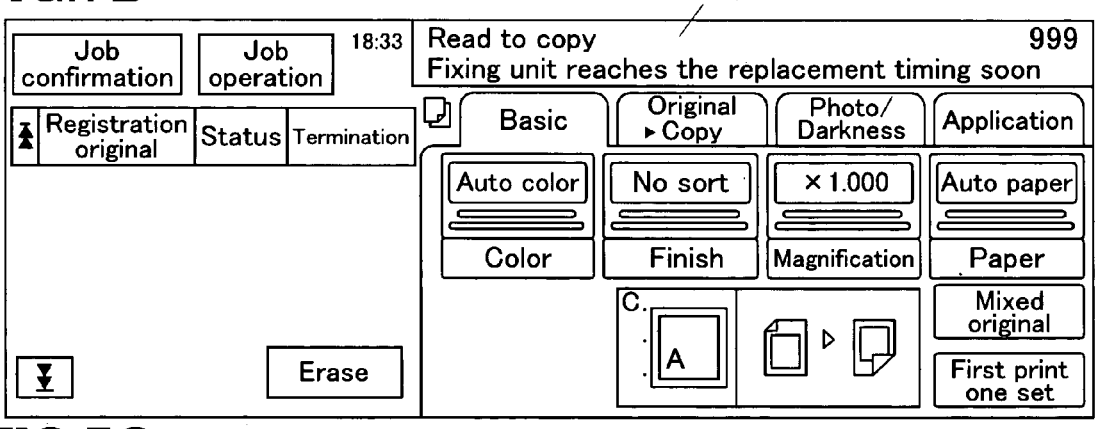
FIG. 7C shows an LCD display portion showing the state in which a copy mode key is pressed when the near life alarm display screen shown in FIG. 7A is displayed.

At S21, in the near life alarm display processing of S14 shown in FIG. 4, it is discriminated whether the "Confirmation & Copy mode" touch key 201 displayed on the LCD display portion 106 is touched or the copy key 203 in the hard key operation portion 108 is pushed. If it is discriminated that any one of the aforementioned keys is touched or pushed (YES at S21), at S22, the entire screen alarm display status of the LCD display portion 106 shown in FIG. 7A is released, and then the LCD display portion 106 displays the copy mode setting screen as shown in FIG. 7C.

At S21, if it is discriminated that none of the "Confirmation & Copy mode" touch key 201 and the copy key 203 of the hard key operation portion 108 is touched or pushed (NO at S21), at S23, it is discriminated whether the "Confirmation & Scanner mode" touch key 202 in the screen shown in FIG. 7A is touched or the scanner key 204 of the hard key operation portion 108 is pushed.

Figure 7D:
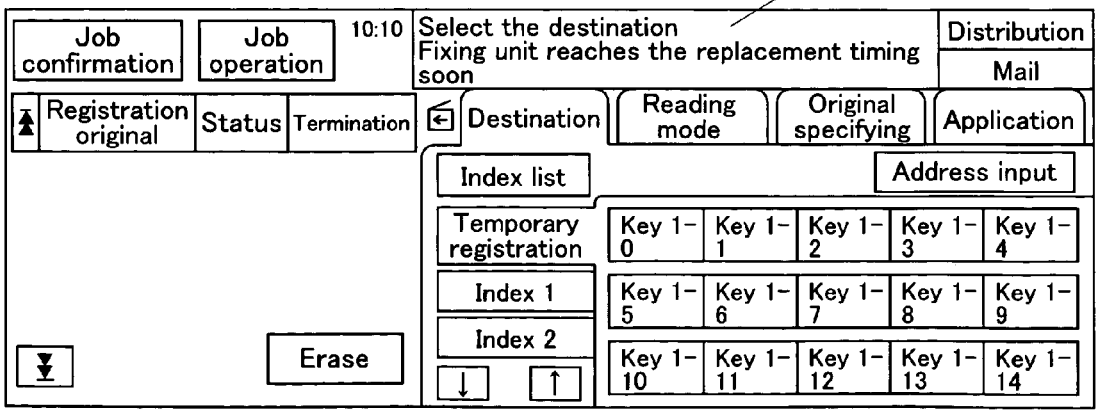
FIG. 7D shows an LCD display portion showing the state in which a scanner mode key is pressed when the near life alarm display screen shown in FIG. 7A is displayed.

If it is discriminate that any one of the aforementioned keys are touched or pushed (YES at S23), at S24, the entire screen alarm status of the LCD display portion 106 shown in FIG. 7A is released and then the scanner mode setting screen is displayed as shown in FIG. 7D. To the contrary, at S23, if it is discriminate that none of the "Confirmation & Scanner mode" touch key 202 and the scanner key 204 of the hard key operation portion 108 is touched or pushed (NO at S23), the routine returns at it is.

As explained above, only in the case where any one of keys among the "Confirmation & Scanner mode" touch key 201 in the display screen of the LCD display portion 106, the "Confirmation & Scanner mode" touch key 202, the copy key 203 and the scanner key 204 of the hard key operation portion 108 is touched or pushed, the copy mode setting screen of S22 or the scanner mode setting screen of S24 is displayed. Even if any key other than the aforementioned keys is touched or pushed, the routine returns and no key operation is accepted. In other words, unless any specific key is operated, any function setting or operation of the MFP1 is not activated, and the near life alarm display is continued. Accordingly, the user can strongly recognize the fact that the consumption article such as the fixing unit 80 and the like has reached the replacement timing thereof.

Next, the life time control S3 (the control to be performed when a consumption article has reached the life) will be explained with reference to FIG. 6.

At 31, in the life alarm display processing of S16 shown in FIG. 4, it is discriminated whether the "Confirmation & Scanner mode" touch key 205 displayed on the LCD display portion 106 shown in FIG. 7B is touched or the scanner key 204 in the hard key operation portion 108 is pushed. If it is discriminated that any one of the aforementioned keys is touched or pushed (YES at S31), at S32, the entire screen alarm display status of the LCD display portion 106 shown in FIG. 7B is released, and then the LCD display portion 106 displays the scanner mode setting screen. Then, the routine returns.

If it is discriminate that none of the "Confirmation & Scanner mode" touch key 205 and the scanner key 204 of the hard key operation portion 108 is touched or pushed (NO at S31), the routine returns at it is.

As explained above, only in the case where any one of keys including the "Confirmation & Scanner mode" touch key 205 of the LCD display portion 106 and the scanner key 204 of the hard key operation portion 108 is touched or pushed, the scanner mode setting screen of S32 is displayed. Even if any key other than the aforementioned keys is touched or pushed, the routine returns and no key operation is accepted. In other words, unless any specific key is operated, any function setting or operation of the MFP1 is not activated, and the life alarm display is continued. Accordingly, in this embodiment, since no print operation can be executed when the fixing unit 80 has reached the life, changing the current mode into a copy mode is not allowed, but only the scanner mode can be executed.

Next, another processing of S4 shown in FIG. 3 will be explained. This processing includes the processing of printing/scanning operation and the processing in the case where a consumption article has reached the life/near life during the operation. In the case where the consumption article has reached the life during the operation, the operation is stopped at that timing, and then the life time alarm is displayed as shown in FIG. 7B. On the other hand, in the case where the processing could be completed during the operation before reaching the life, but the consumption article has reached the near life, the near life alarm is displayed as shown in FIG. 7A.

As explained above, in this embodiment, in the case where the power switch is turned on or the power saving mode is released when the exchangeable consumption article is in the near life or life state, an alarm indicating that the consumption article has reached the near life or life is displayed on the operation screen. Furthermore, the releasing of the alarm display and the function setting/operation cannot be executed unless a specific operation is performed. Therefore, the alarm status can be assuredly notified the user of the prompt replacement of the consumption article.

In the aforementioned embodiment, both the turning of the power and the releasing of the power saving mode are detected to discriminate whether there exists the life or near life unit at the time of the detection. However, it is possible that one of the turning of the power and the releasing of the power saving mode is detected to discriminate whether there exists the life or near life unit at the time of the detection.

Furthermore, although the explanation of this embodiment is directed to the processing to be executed when a fixing unit has reached the near life or life, the processing can also be applied to any other consumption articles/units including the imaging unit, the toner cartridge, the paper feeding unit, the paper ejecting unit and the like.

While illustrative embodiments of the present invention have been described herein, the present invention is not limited to the various preferred embodiments described herein, but includes any and all embodiments having modifications, omissions, combinations (e.g., of aspects across various embodiments), adaptations and/or alterations as would be appreciated by those in the art based on the present disclosure. The limitations in the claims are to be interpreted broadly based the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited.

What is claimed is:

1. An image forming apparatus, comprising:

a first detector for detecting that a consumption article has reached its life;

a second detector for detecting that the consumption article has reached a certain timing before its life;

a third detector for detecting an application of power and/or releasing of a power saving mode of the image forming apparatus;

a first controller for making a display portion provided at the image forming apparatus display an alarm advising a replacement of the consumption article and for making the image forming apparatus inactive in a case where the application of power and/or the releasing of the power saving mode of the image forming apparatus is detected by the third detector after the second detector detects that the consumption article has reached the certain timing before its life but before the first detector detects that the consumption article has reached its life; and a second controller for releasing the alarm display and enabling the use of the image forming apparatus when a specific input is operated during the displaying of the alarm on the display portion.

2. The image forming apparatus as recited in claim 1, wherein the alarm display is performed using an entire screen of the display portion.

3. The image forming apparatus as recited in claim 1, wherein the specific input is a touch key to be displayed on a part of a display screen where the alarm is displayed.

4. The image forming apparatus as recited in claim 1, wherein the consumption article is an imaging unit including a photosensitive drum.

5. The image forming apparatus as recited in claim 1, wherein the consumption article is a fixing unit including a fixing roller.

6. The image forming apparatus as recited in claim 1, wherein the consumption article is a toner cartridge.

7. The image forming apparatus as recited in claim 1, wherein the consumption article is a paper feeding unit.

8. A control method of an image forming apparatus equipped with a first detector for detecting that a consumption article has reached its life, a second detector for detecting that the consumption article has reached a certain timing before its life, and a third detector for detecting an application of power and/or releasing of a power saving mode of the image forming apparatus, the method comprising:

executing a content of a first controller for making a display portion provided at the image forming apparatus display an alarm advising a replacement of the consumption article and for making the image forming apparatus inactivate in a case where the application of power and/or the releasing of the power saving mode of the image forming apparatus is detected by the third detector after the second detector detects that the consumption article has reached the certain timing before its life but before the first detector detects that the consumption article has reached its life; and executing a content of a second controller for releasing the alarm display and enabling the use of the image forming apparatus when a specific input is operated during the displaying of the alarm on the display portion.

9. The control method as recited in claim 8, wherein the alarm display is performed using an entire screen of the display portion.

10. The control method as recited in claim 8, wherein the specific input is a touch key to be displayed on a part of a display screen where the alarm is displayed.

11. The control method as recited in claim 8, wherein the consumption article is an imaging unit including a photosensitive drum.

12. The control method as recited in claim 8, wherein the consumption article is a fixing unit including a fixing roller.

13. The control method as recited in claim 8, wherein the consumption article is a toner cartridge.

14. The control method as recited in claim 8, wherein the consumption article is a paper feeding unit.

* * * * *